United States Patent [19]

Siegl

[11] 4,133,522

[45] Jan. 9, 1979

[54] PIVOTING TRAY SORTING APPARATUS

[75] Inventor: William F. Siegl, Rochester, N.Y.

[73] Assignee: Xerox Corporation, Stamford, Conn.

[21] Appl. No.: 339,674

[22] Filed: Mar. 9, 1973

[51] Int. Cl.[2] ..... B65H 29/60; B65H 31/24

[52] U.S. Cl. ..... 271/173; 271/65

[58] Field of Search ..... 271/64, 65, 66, 173; 270/58

[56] References Cited

U.S. PATENT DOCUMENTS 3,774,902 11/1973 Schulze ..... 271/64 X

OTHER PUBLICATIONS

Cooper, L. M. "Sheet Stacker," *IBM Technical Disclosure Bulletin,* vol. 14, No. 5, Oct. 1971, p. 1452.

*Primary Examiner*—Bruce H. Stoner, Jr.

[57] ABSTRACT

Sorting apparatus in which tray assemblies in a vertical array are opened to facilitate feeding in sheets carried on a transport past the tray assemblies. The tray assemblies are hinged at one end to pivot when engaged by gear mechanism carried on a reciprocating apparatus. A deflector operatively associated with reciprocating apparatus deflects the sheets from the transport as each tray assembly is pivoted open in succession.

7 Claims, 6 Drawing Figures

PIVOTING TRAY SORTING APPARATUS

This invention relates to apparatus for sorting copies advanced from a high speed copier/duplicator into collated sets in a compact area.

In copier/duplicator systems sorters normally have included sorting bin modular units with a multitude of trays as described in U.S. Pat. Nos. 3,561,754, 3,356,362, 2,876,008, 2,951,697, and 3,076,647. While these constructions are satisfactory they have certain disadvantages such as the number of trays that can be accommodated in a compact space and the ease at which the trays can be unloaded.

The present invention is, generally speaking, a sorter/collator adapted for universal usage with the copier/duplicator of all types. The compact arrangement of the bins or trays and the manner in which they receive copy sheets enables a highly reliable copier sorter/collator system for rapid distribution of copy sheets into collated sets.

It is therefore a general object of this invention to improve distribution of copy sheets.

It is another object of this invention to enable the distribution of copy sheets in collated sets in a reliable manner.

It is still a further object of the invention to achieve sorting of copy sheets into a tray configuration which is simple and compact in construction.

It is still a further object of the invention to reduce significantly the level of noise normally associated with the sorting of sheet material.

Figure 1:
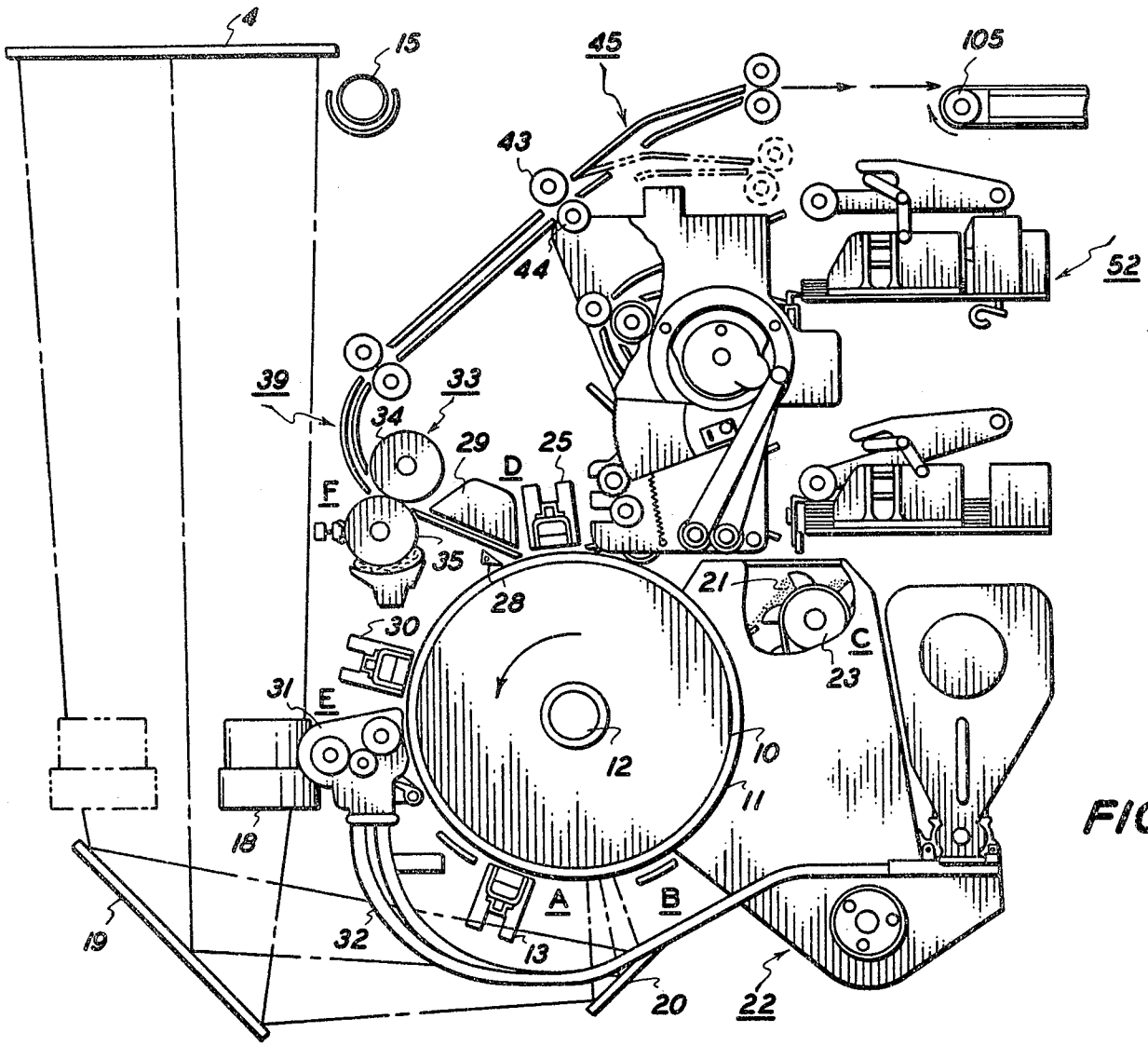
FIG. 1 is a schematic view of a xerographic copier/duplicator machine producing copies to be sorted by sorting apparatus according to the present invention.
Figure 2:
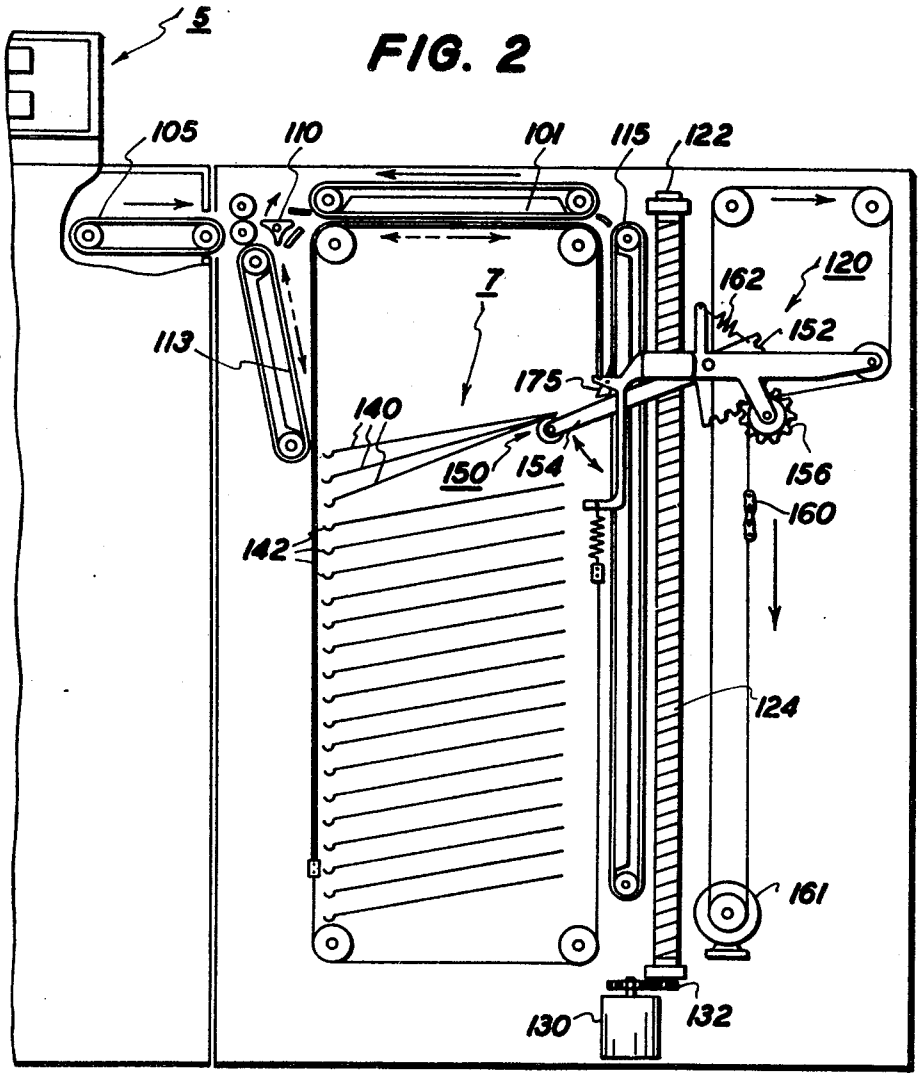
FIG. 2 is a side view of sorting apparatus according to the present invention.

FIG. 1 shows a schematic of the copier/duplicator system generally designated 2 including a copier machine 3, which is a high speed copier/duplicator capable of producing simplex or duplex copies at the option of a machine operator. The copier machine 3 has a platen 4 for receiving documents to be reproduced, and a control panel 5 (FIG. 2) which includes various control knobs, buttons, and switches for selecting various modes of operation such as simplex and duplex copies and the number of copies to be reproduced. In accordance with the invention, the copier/duplicator system includes a sorting apparatus 6 having tray assemblies 7 (FIG. 2).

The copier/duplicator system includes an automatic xerographic apparatus which includes a photosensitive plate including a photoconductive layer 10 that is placed over a conductive backing. The plate is formed in the shape of a drum 11 and the drum mounted upon a shaft 12 that is journaled for rotation in the machine frame. Basically, the xerographic drum is rotated in the direction indicated so as to pass sequentially through a series of xerographic processing stations. The photosensitive drum and the xerographic processing apparatus are driven at predetermined speeds relative to each other from a drive system (not shown) and the operation thereof coordinated in order to produce proper cooperation of the various processing mechanisms.

The original to be reproduced is placed upon a transparent horizontally supported platen 4 and the original scanned by means of a moving optical scanning system and to produce a flowing light image of the original. The scanning system includes an elongated horizontal extended aperture lamp 15 and a movable lens element 18.

The lamp and lens element moves in coordination across the object supported upon the platen to focus successive incremental bans of illumination reflected from the object onto the moving drum surface at synchronous speeds therewith. The optical path is folded by means of a pair of image mirrors 19 and 20 interposed between the lens and the drum surface, the drum is first uniformly charged by means of a corona generator 13 positioned in charging station A. Under the influence of the flowing light image, the uniformly charged photoconductive surface is selectively dissipated in the non-image areas to form what is commonly known as a "latent electrostatic image."

The latent electrostatic image is carried on the drum surface from the exposure station into the developing station C. The developing station is primarily comprised of a developer housing 22 adapted to support a supply of two-component developer material 21 therein. The developer material is transported by means of a bucket system 23 from the bottom of the developer housing to an elevated position where the material is delivered into the active development zone. The developer material is caused to flow downwardly in contact with the upwardly moving drum surface under closely controlled conditions wherein charged toner particles are attracted from the developer mix into the image areas on the plate surface thus making the image visible.

The moving drum surface next transports the developed xerographic image to a transfer station D. Cut sheets of final support material are moved into the transfer station, the backside of the copy sheet is sprayed with an ion discharge from a transfer corotron 25 inducing on the sheet a charge having a polarity and magnitude sufficient to attract the toner material from the drum surface to the final support material. This induced charge also electrostatically tacks the final support material to the drum surface. In order to remove the copy sheet from the drum surface, a stripper finger 28 is positioned downstream from the transfer corotron. The finger is arranged to move between the drum surface and the copy sheet and lifts the sheet from the drum surface and the copy sheet is directed along a predetermined path of travel into contact with a stationary vacuum transport 29.

Although a preponderance of the toner material is transferred from the drum surface to the copy sheet during the transfer process, invariably some residual toner remains behind on the drum surface after transfer. This residual toner is transported on the drum surface into a cleaning station E where it is brought under the influence of a cleaning corotron 30 adapted to neutralize the electrostatic charge tending to hold the residual toner to the drum surface. The neutralized toner is mechanically cleaned from the drum surface by means of a brush or the like and the toner collected within a housing 31. A conveyor moving in an endless loop through tubes 32 transport the collected residual toner back to the developer housing where it is deposited within the developer mix so that it can be once again reused in the xerographic developing process.

The copy sheet, which has been removed from the drum surface after the transfer operation, is moved along stationary transport 29 into fusing station F. The fuser 33 is basically made up of an upper fuser roll 34 and a lower fuser roll 35 mounted in operative relation to each other and arranged to coact so as to support a sheet of material in pressure driving contact therebetween. The lower roll is heated. As the heated roll is rotated in the direction indicated, the heated surface of the lower roll is pressed into intimate contact with the image face of the support sheet. Mechanical and heat energy transported from the roll surface to the support sheet permanently bond the toner particles to the support material.

Upon leaving the fuser, the fixed copy sheet is passed through a curvalinear sheet guide system, generally referred to as 39, into cooperating advancing rolls 43 and 44. At this point, depending on the mode of operation selected, the copy sheet is either forwarded directly to the sorter or into the upper supply tray 52 by means of a movable sheet guide 45 before entering the sorter.

It is believed that the foregoing description is sufficient for purposes of the present application to show the general operation of a xerographic reproducing machine. For a more detailed explanation of the copier/duplicator xerographic components reference is made to U.S. Pat. No. 3,645,615 entitled Copying Apparatus.

Sorter apparatus 6 includes a vacuum transport 101 which receives copy sheets from a transport 105 of the copier machine. A deflector gate member 110 is positioned in front of the entrance to transport 101 to direct the copy sheet first onto another vacuum transport 113 when operating in the duplex mode of operation. Vacuum transport 113 is reversibly driven by any suitable device to reverse the copy sheet with trailing edge first onto transport 101. For simplex mode of operation the gate member 110 is positioned to permit the sheet to pass directly onto transport 101. The copy sheets advance from transport 101 onto a transport 115 from which they are directed to the tray assemblies 7 by a carriage assembly 120 as will be described hereinafter.

The carriage assembly 120 moves vertically up and down on cam member 122 which is formed with a spiral shaped groove 124 which is received in a portion of carriage assembly 120. Cam member 122 is driven by a drive motor 130 which drives a gear 132 mounted to the cam member. Drive motor 130 is reversible to move the carriage assembly up and down past a vertical array of tray assemblies 7.

Figure 3:
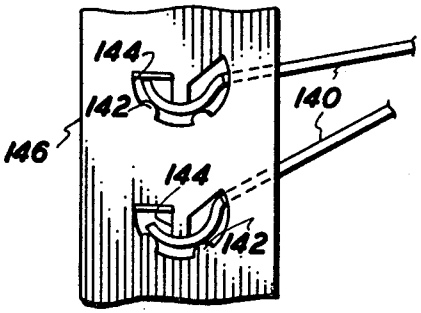
FIG. 3 is an exploded view illustrating details of the pivot end of the tray assemblies.

Tray assemblies 7 include elongated tray members 140 which terminate in a hook portion 142 (FIG. 3) which abuts against crescent shaped cavity 144 formed in post members 146 on the sorter frame. By this structure the tray members can pivot through an arc defined to the extent of travel of hook portion 142 within the opening of cavity 144.

To pivot the tray assemblies open is a pivoting arm assembly 150 which includes a segmented gear 152 fixed to a pivot arm 154 which engages the tray member at the sheet entry end. To actuate the pivoting arm assembly 150 is a gear driver 156 carried on carriage assembly 120. Gear driver 156 is driven by a chain 160 and motor drive 161 through a one way clutch. After the tray member is pivoted to its opened position and a copy is delivered power is removed from the gear driver. At this time, segmented gear 152 is returned to its rest position through the action of a spring 162.

In operation copy sheets are advanced from the transport 105 to carriage assembly 120 which is indexed from a home position at the top downwardly stopping at the selected tray assembly. At this time drive 160 is activated to pivot open the tray assembly. Pick off fingers 175 direct the copy onto the tray. The carriage moves down to each tray assembly in succession. This continues with each tray assembly in succession when the carriage assembly reaches the bottom it reverses motion to return to the home position to repeat the cycle.

It will be appreciated that the sorter apparatus drives are timed with the position of the sheets through the use of suitable sheet detection devices and control logic. It will be further appreciated that with the copy inverter apparatus as described above sorting in collated sets of both simplex and duplex copies is accomplished.

Figure 4:
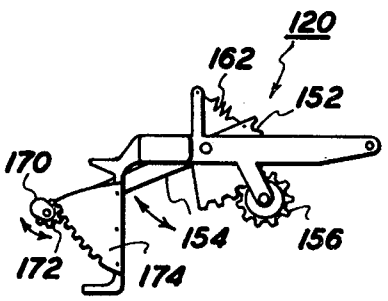
FIG. 4 is an exploded view of an alternative embodiment for pivoting the tray assemblies into the opened position.

Shown in FIG. 4 is an alternative embodiment of the invention which uses an eccentric camming member 170 which is driven by a gear 172 meshing with segmented gear 174 carried on the carriage assembly 120. In this manner a greater pivot arc and hence tray assembly opening is obtained.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. Sorting apparatus comprising;

a frame;

an array of closely spaced tray members each pivotably supported by said frame;

conveyor means for conveying sheets past an inlet of each of said tray members;

carriage means operatively associated with said conveyor means adapted for movement past the inlets of said tray member;

said carriage means carrying deflector means for directing a sheet from said conveyor means towards the inlet of a predetermined tray member; and actuating means operatively associated with said carriage means for pivoting a predetermined tray member from a first position in which the inlet thereof is closely spaced to a second position in which said inlet opening is extended as a sheet is directed thereinto.

2. A sheet distributing device comprising conveyor means disposed to convey sheets on a path of travel, gating means operatively associated with said conveyor means to selectively divert the conveyed sheets at a plurality of locations on said path of travel, bin means including a plurality of catch trays defining a plurality of sheet receiving pockets each having an entrance opening oriented toward said conveyor means in alignment with said selected sheet diverting locations defined by said gating means, and actuating means associated with said catch trays and said gating means to selectively move one of said catch trays relative to an adjacent tray to increase the size of the entrance opening of the pocket aligned with the sheet diverting location defined by said gating means;

said acutating means including means pivotally mounting said catch trays for movement between an open position and a normal position, and means responsive to the position of said gating means to pivot one of the catch trays defining the pocket aligned therewith to its open position.

3. Apparatus according to claim 1 wherein said actuating means is driven by a drive means from a first position of the actuating means wherein said predetermined tray member assumes its said first position, to a second position of said actuating means wherein said tray member assumes its said second position, and a spring means is connected to said actuating means to return said actuating means to its said first position when said drive means is deenergized.

4. Apparatus according to claim 3, wherein said carriage means is driven in a reciprocating fashion past said tray members by a cam shaft member formed with a spiral groove cooperating with said carriage means which advances said carriage means a predetermined extent upon rotation of said shaft member.

5. Apparatus according to claim 3 wherein said actuating means includes a pivot arm having a segment gear member at one end thereof.

6. Apparatus according to claim 5 wherein said actuating means further includes another segment gear member at the opposite end of the pivot arm.

7. Apparatus according to claim 1 including sheet inverter means positioned in advance of said carriage means.

* * * * *